United States Patent [19]

Cola

[11] 4,099,098

[45] Jul. 4, 1978

[54] DISPLAY PANEL

[75] Inventor: Rudolph A. Cola, Malvern, Pa.

[73] Assignee: Burroughs Corporation, Detroit, Mich.

[21] Appl. No.: 800,781

[22] Filed: May 26, 1977

Related U.S. Application Data

[63] Continuation of Ser. No. 635,918, Nov. 28, 1975, abandoned.

[51] Int. Cl.[2] ..... H05B 37/00; H05B 39/00; H05B 41/00

[52] U.S. Cl. ..... 315/169 TV; 313/197; 313/217; 340/324 M

[58] Field of Search ..... 315/169 TV; 313/197, 313/198, 217, 220; 340/324 M

[56] References Cited

U.S. PATENT DOCUMENTS

| | | | |
|---|---|---|---|
| 3,882,342 | 5/1975 | Kamegaya et al. | 313/188 |
| 3,886,389 | 5/1975 | Ogle | 313/188 |

*Primary Examiner*—Saxfield Chatmon, Jr.
*Attorney, Agent, or Firm*—Kevin R. Peterson; Robert A. Green; Edward J. Feeney, Jr.

[57] ABSTRACT

The panel comprises a base plate which carries a plurality of column cathode strips which are oriented parallel to each other, with insulating means dividing the surface of each such strip into a column of a plurality of separate operating areas including display cathode areas and priming cathode areas, the latter providing excited particles for use by the display areas. The display cathodes and priming cathodes are arrayed in rows and columns, and, in each column, there are gas communication paths between priming cathode areas and display cathode areas. In addition, there are gas communication paths along each row of priming cathodes. A separate display anode is provided in operative relation with each row of display cathodes, and a separate priming anode is provided in operative relation with each row of scan cathodes, and each crossing of an anode and cathode area forms a display cell or a priming cell.

In operation of the panel, each column of scanning cells is energized successively and in turn by connection of all of the priming anodes in an operating circuit and by energization of each cathode strip separately and sequentially. Since only the priming anodes are energized, only the priming cells and the priming cathode areas are energized. As each column of priming cathodes is energized, information signals are applied to selected display anodes, and this causes cathode glow to transfer through the appropriate gas communication paths to the display cathodes associated with the selected display anodes, from the associated priming cathodes. As each column of cells is thus energized in turn and all of the columns are energized sequentially, and selected display cathodes are energized, a changeable but visually stationary message is displayed by the energized display cathodes.

21 Claims, 15 Drawing Figures

Fig. 1
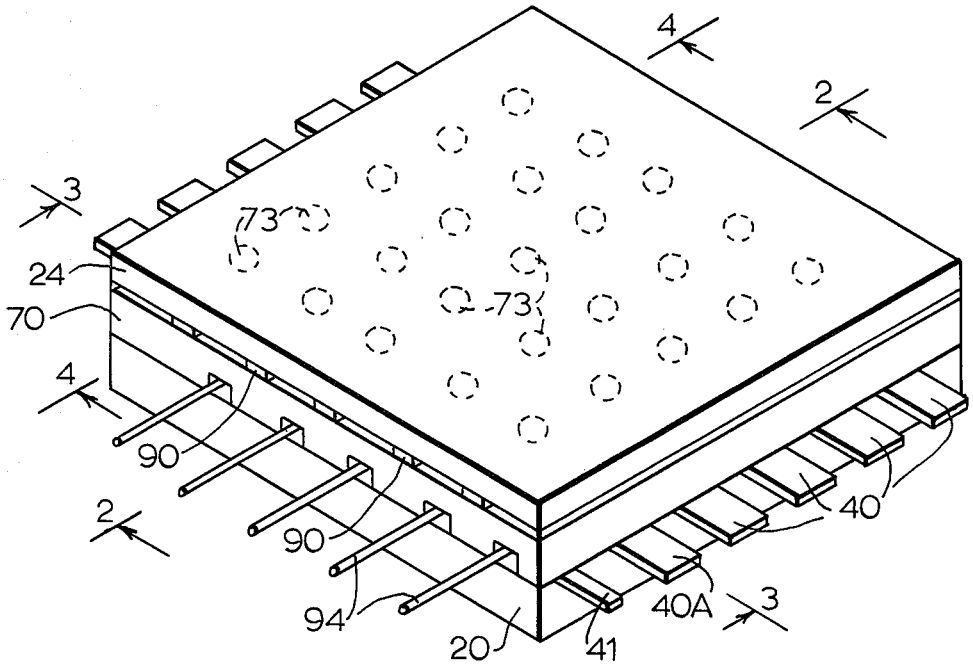
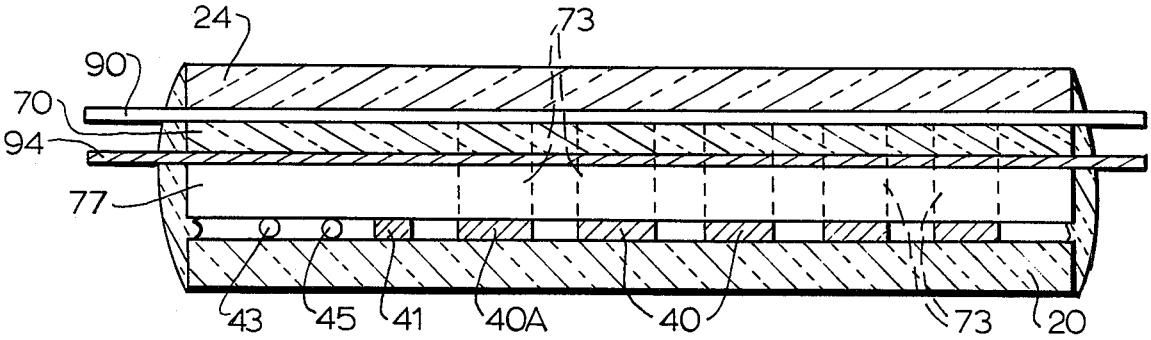
Fig. 2

Fig. 3
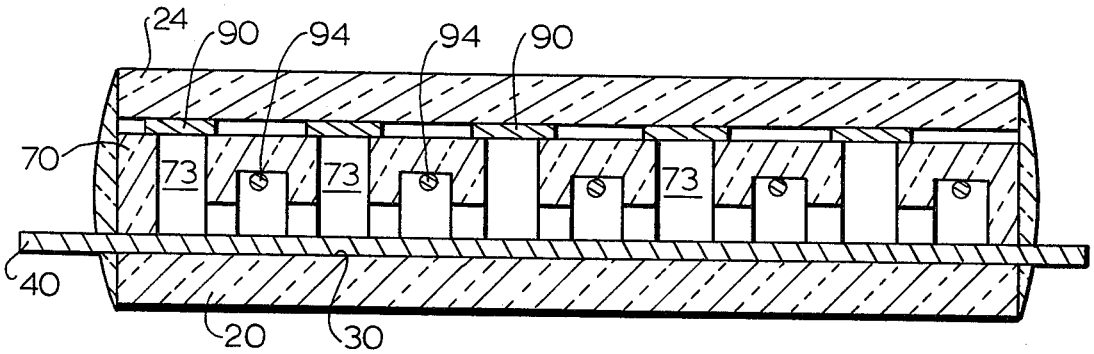
Fig. 4
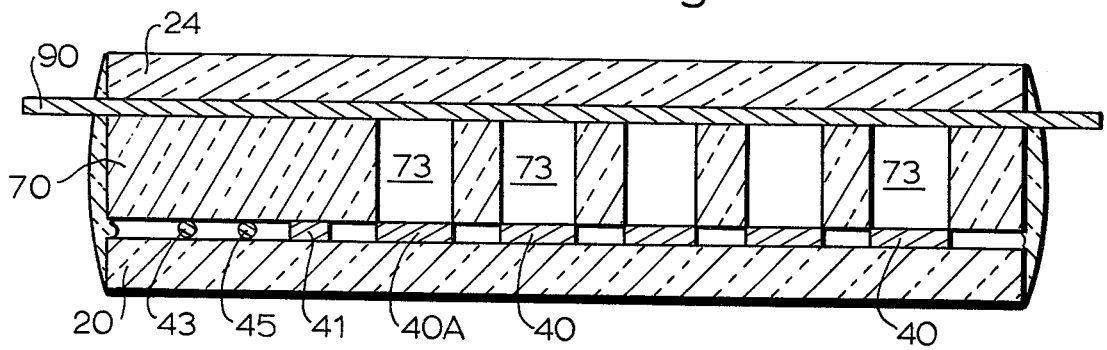
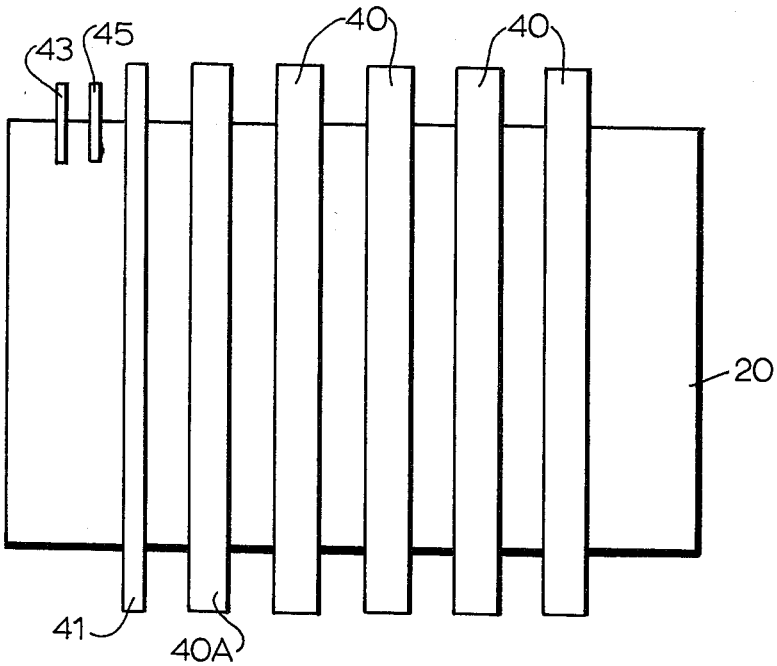
Fig. 5

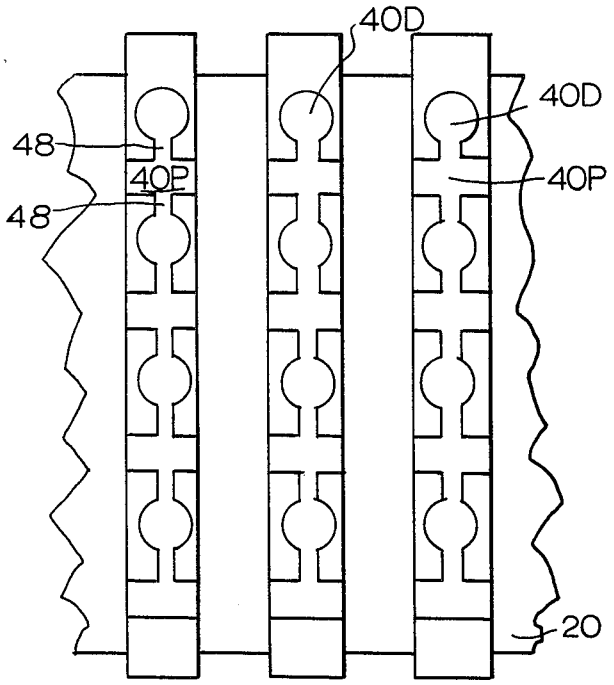
Fig. 6
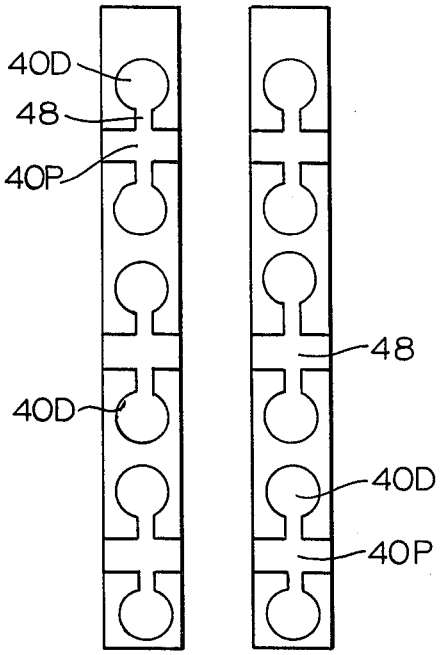
Fig. 7
Fig. 8
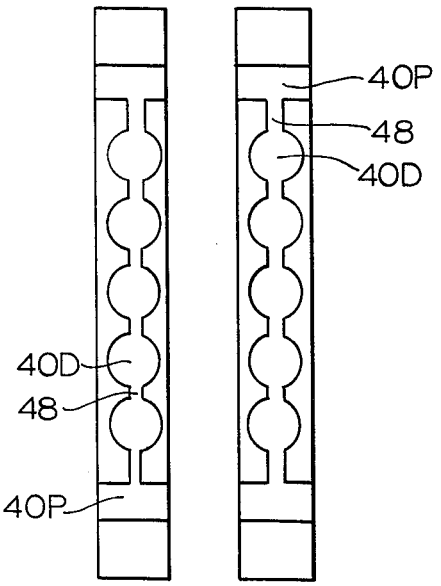
Fig. 9
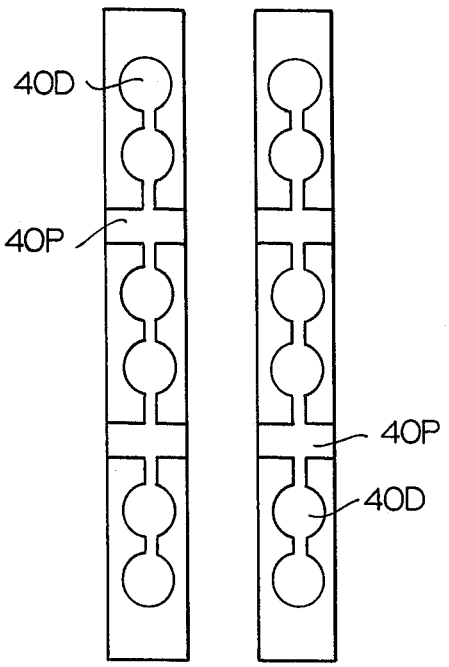

Fig. 10
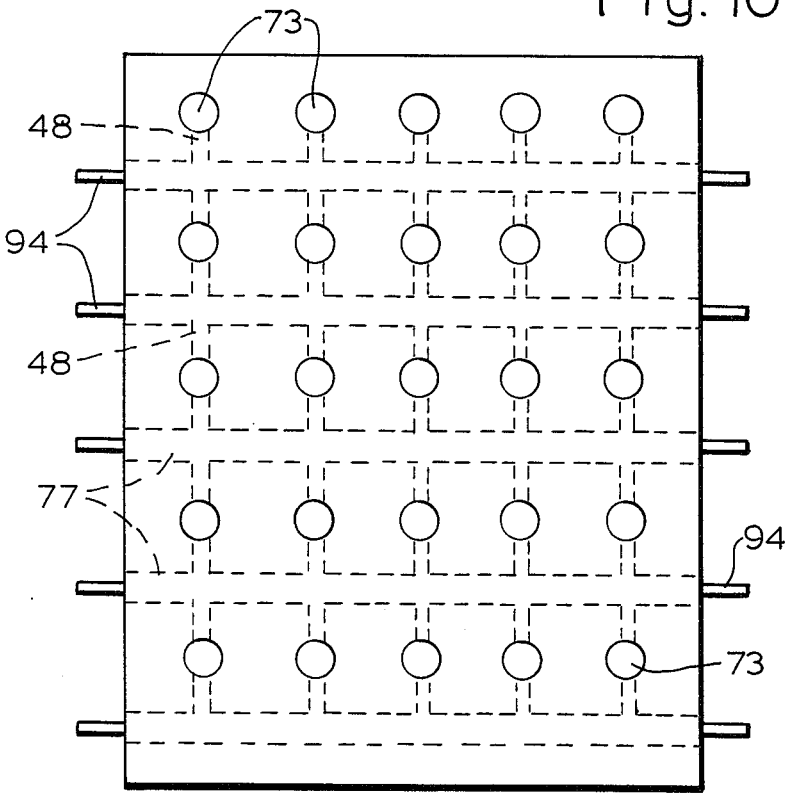
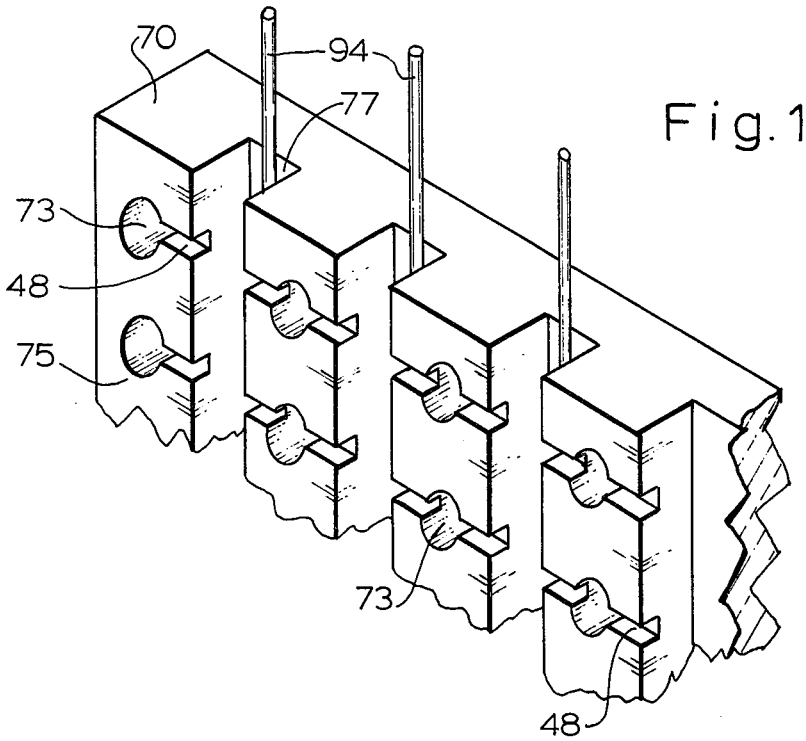
Fig. 11

Fig. 12
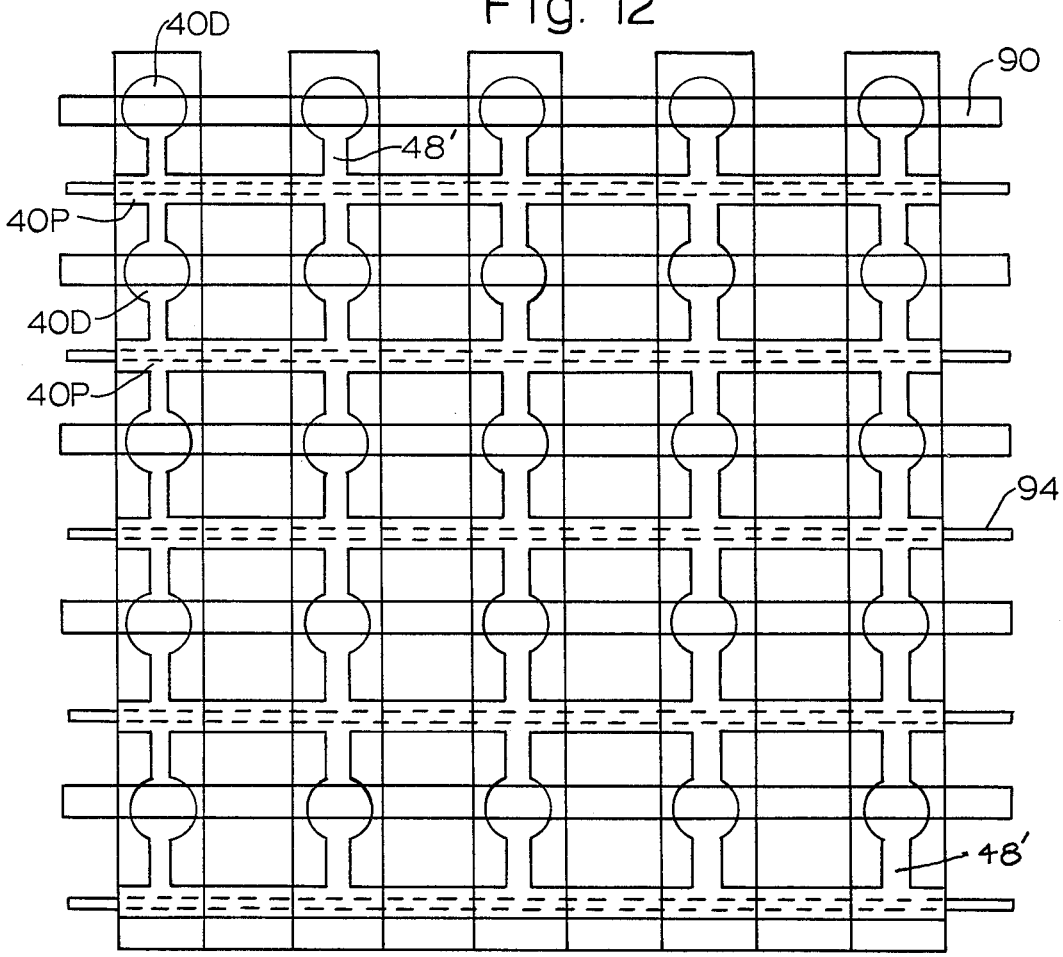
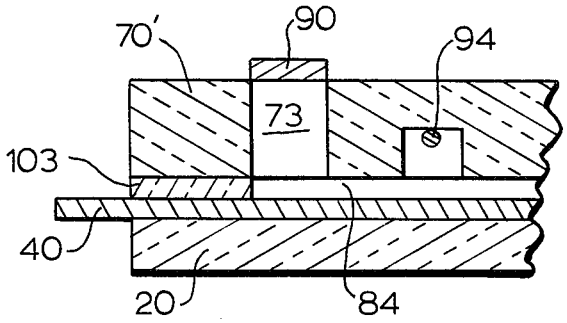
Fig. 15

DISPLAY PANEL

CROSS-REFERENCE TO RELATED APPLICATION

This application is a continuation of application Ser. No. 635,918; filed Nov. 28, 1975 now abandoned.

BACKGROUND OF THE INVENTION

The principles of the invention relate to display panels of the type known as SELF-SCAN panels which are manufactured and sold by Burroughs Corporation. These panels are dot matrix devices which display characters by energizing and generating light in selected cells in a matrix of cells, usually a 5 × 7 matrix, with the total number of energized cells displaying a character. SELF-SCAN panels include separate arrays of scanning cells and display cells which are electrically connected to form a plurality of such 5 × 7 or other matrices, with the scanning cells being adapted to assist in the energization of selected display cells in accordance with input signal information. One form of SELF-SCAN panel is shown and described in U.S. Pat. No. 3,821,586. Panels of this type have achieved commercial success; however, there is a constant need for simplification in the component parts and structure of such devices for mass production manufacture. The present invention provides such simplification.

SUMMARY OF THE INVENTION

Briefly, a display panel embodying the invention includes a plurality of parallel column cathode strips including means dividing the surfaces of the strips into a plurality of separate operating areas, with similar strips being disposed in alignment in rows. The columns of areas thus formed include scanning or priming cathode areas and display cathode areas, and separate anodes are provided for separately energizing each row of display cathodes and each row of priming cathodes. The panel is operated by separately energizing each column of priming cathodes and selectively transferring cathode glow to the associated display cathodes in accordance with input signal information applied to selected display anodes, the total number of display cathodes thus energized displaying a character or message.

DESCRIPTION OF THE DRAWINGS

FIG. 1 is a perspective view of the parts of a display panel embodying the invention;

FIG. 2 is a sectional view, along the lines 2—2, in FIG. 1;

FIG. 3 is a sectional view, along the lines 3—3, in FIG. 1;

FIG. 4 is a sectional view, along the lines 4—4, in FIG. 1;

FIG. 5 is a plan view of the base plate of the panel of FIG. 1 and the electrodes which are supported thereon;

FIG. 6 is a plan view of a portion of the base plate of the panel of FIG. 1 and some of the cathodes treated to form separate operating areas;

FIG. 7 is a plan view of a modification of the cathodes shown in FIG. 6;

FIG. 8 is a plan view of another modification of the cathodes of FIG. 6;

FIG. 9 is a plan view of still another modification of the cathodes of FIG. 6;

FIG. 10 is a plan view of an insulating plate used in the panel of FIG. 1 and some of the electrodes associated therewith;

FIG. 11 is a perspective view of the bottom portion of the plate of FIG. 10;

FIG. 12 is a schematic representation of all of the electrodes used in the panel of FIG. 1;

FIG. 15 is a sectional view, along a portion of the line 15—15, shown in FIG. 14.

DESCRIPTION OF THE PREFERRED EMBODIMENTS

Figure 13:
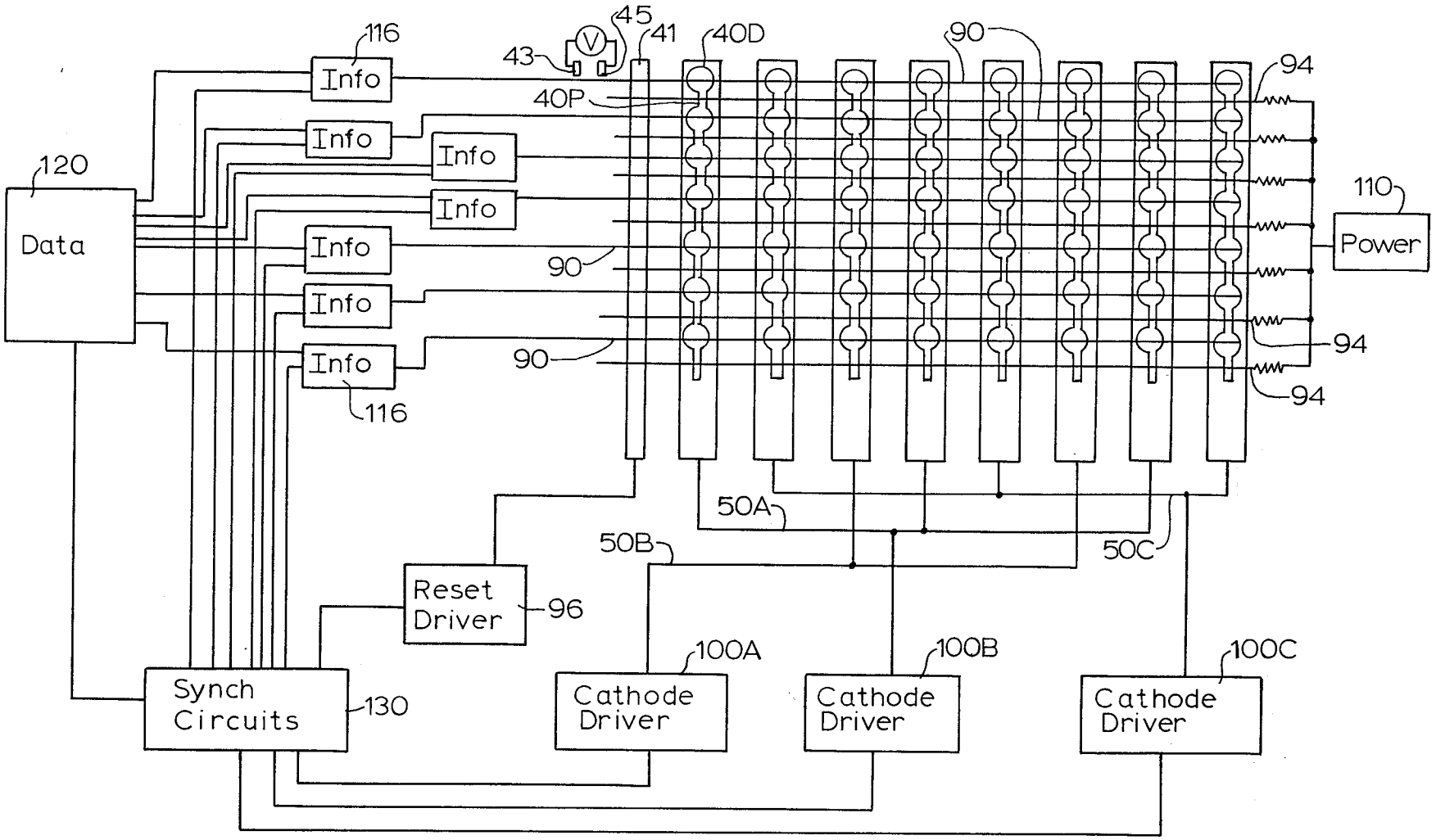
FIG. 13 is a schematic representation of the panel of the invention and a system in which it may be operated.

A display panel 10 embodying the invention includes a gas-filled envelope made up of a base plate 20 and a face plate 24 hermetically sealed together, with the face plate serving as the viewing window for the envelope. The base plate 20 is of insulating material such as glass, ceramic, or the like, and has a top surface 30, on which are provided a plurality of cathode strips 40 of conductive material disposed vertically parallel to each other with their top surfaces facing the face plate viewing window. The cathode electrodes 40 are formed on the base plate surface, for example, by a screen printing process using any suitable material such as a mixture of nickel and glass frit in a suitable binder. The portions of the cathodes shown extending from the base plate and the panel represent external connections thereto.

An auxiliary conductive strip 41, used as a reset cathode in a scanning operation to be described, is disposed adjacent to the first cathode strip 40A at the left-hand end of panel 10. This is arbitrarily considered to be the end at which a column scanning cycle, to be described, is initiated. In addition, at least one keep-alive cell, comprising a cathode 43 and an anode 45, is provided close to the reset cathode 41, as is well known in the art. U.S. Pat. No. 3,886,389 is one of many patents which illustrate the use of a reset cathode and a keep-alive cell in a cell-scanning panel.

As illustrated schematically in FIG. 6, means are provided for dividing the top surfaces of the cathode strips 40 into a plurality of operating areas arranged in a column. Each of the cathode strips is sub-divided in the same way so that rows of similar operating areas are formed including areas 40D, display areas, and areas 40P, priming areas. The display areas can communicate through gas communication paths 48 with the priming areas 40P which generate excited particles which diffuse to the display areas and facilitate their turn-on and glow. The cathode priming areas are not used for display purposes, and they may be, and preferably are, smaller than the display areas. The display areas form a matrix of light-producing areas or dots which are operated in any suitable combination, for example, as 5 × 5 arrays, 5 × 7 arrays, or the like, to form characters, as is well known in the art. The number of dots or display areas shown in the drawings is merely illustrative, and any desired number may be provided in an operating panel so that a panel can display one character or a plurality of characters.

As illustrated in FIG. 6, the display and priming areas may alternate with each other in a column; or, as illustrated in FIG. 7, each two display areas 40D may have a priming area 40P between them; or, as illustrated in FIG. 8, priming areas may be provided at the upper and lower ends of a column of display areas 40D; or, as illustrated in FIG. 9, a column of areas may include two or three display areas in series, a priming area, then two or three display areas, then a priming area, etc. In each case, the means which sub-divides the surface of the cathodes in shaped or positioned to provide relatively small gas communication paths, to be described, through which excited particles can flow from priming cathode areas to display cathode areas.

The sub-dividing means, in one arrangement, comprises an insulating plate or layer 70 disposed over the cathodes, with holes or cells 73, of any suitable shape and size, formed therethrough, with each cell overlying and aligned with a display cathode area 40D. The cells 73 are thus arrayed in rows and columns and comprise the viewable display cells in the completed panel. In addition, the lower portion 75 of plate 70, adjacent to the base plate, is provided with horizontal slots or depressions 77, in which priming or scanning anode electrodes 94, for example, in the form of coatings or wires, are seated. Each priming anode wire 94 is spaced from, and overlies, a row of cathode priming areas 40P. The slots 77 are deep enough to space the priming anodes 94 from the cathodes 40 a distance suitable to provide good electrical operation between these electrodes. The desired mechanical dimensions and electrical characteristics can be readily determined and achieved by those skilled in the art. Display anodes 90 are provided overlying the rows of cathode display areas 40D, and these anodes 90 are preferably transparent conductive films of tin oxide formed on the lower surface of the face plate. The display anodes 90 might also be wires seated on the top surface of the insulating plate 70. Each crossing of a priming anode electrode 94 and a cathode priming area 40P forms a priming cell, and each crossing of a display anode 90 and a display cathode area 40D forms a display cell, and these priming and display cells are arrayed in rows and columns. In addition, each crossing of a priming anode and the reset cathode 41 forms a reset cell. The relationship between the various electrodes is illustrated schematically in FIG. 12.

It is noted that plate 70 prevents the priming cathode areas 40P and the priming cells from being seen through the face plate 24.

The lower portion of plate 70 is also provided with vertical slots 48 which permit diffusion of excited particles vertically along a column of cathode areas, especially between a cathode priming area 40P and a cathode display area 40D. The vertical slots perferably have a vertical height of about one to three mils and any suitable width, for example, equal to or less than the width of a cathode strip 40 but no less than about three mils.

The panel 10 is filled with a suitable ionizable gas such as neon, xenon, or the like, singly or in combination, at a suitable pressure in the range of about 150 Torr to 600 Torr. The gas atmosphere also includes mercury vapor to minimize cathode sputtering.

The principles of operation of panel 10 are generally the same as those which apply to SELF-SCAN panels of the type made and sold by Burroughs Corporation and described in U.S. Pat. No. 3,875,474, which is incorporated herein by reference.

In the operation of panel 10, referring to FIG. 13, the cathode strips 40, with their operating areas 40D and 40P, are electrically connected in groups by means of leads 50A, 50B, 50C, with every fourth cathode being in the same group so that there are three such groups of cathodes. The interconnections 50 may be formed on base plate 20. It will be clear to those skilled in the art, from the following description of the invention and from information already known about SELF-SCAN panels, that other electrode groupings can be used or even that each electrode can be separately connected to an external circuit. However, the electrode groupings provide economies in circuit operation.

It is noted that, even though the separate areas of each cathode strip are electrically connected, because of the separate anodes overlying each cathode area and because the scan and display anodes are shielded from each other by plate 70, when a cathode strip is energized, the areas of the cathode can be separately energized and caused to glow by energization of the appropriate anode.

A system for operating panel 10 is shown in FIG. 13. In the system, the keep-alive electrodes 43 and 45 are connected to a source of potential V, by means of which the keep-alive cell is maintained continually energized and generating excited particles. The reset cathode 41 is connected to a reset driver 96, and the groups of cathodes 40 are connected by their conductors 50 to separate cathode drivers 100 for connecting each cathode group in an operating circuit. All of the scan anodes 94 are connected together through a suitable resistive path, if required, to a source of generally positive operating potential 110. Each of the display anodes 90 is connected through a separate, suitably resistive path to a source 116 of information signals which themselves are connected to a data source 120 which may include a computer, encoders, decoders, character generator, and the like circuit modules. Suitable synchronizing control circuits 130 are provided for interrelating the various circuit elements to operate as described below.

With the keep-alive cell ON, and all of the scan anodes 94 energized, a pulse or other signal is applied by souce 50R to the reset cathode 41 which turns on, exhibits cathode glow, and generates excited particles.

The excited particles thus generated are present near the first column of scan cathodes 40P, and, when the first cathode driver 50A is operated to connect the first column of scan cathodes in circuit with the scan anodes, these scan cathodes turn on, exhibit cathode glow, and generate excited particles. Although other columns of scan cathodes in the same group are energized at the same time, they do not glow. This is because the first column of scan cathodes turns on preferentially because it is close to the reset cathode 41 and to the excited particles generated thereby. These particles do not diffuse to the other columns of scan cathodes in the group. In addition, when the first column of scan cathodes turns on, it quickly assumes sustaining potential which is lower than the required firing potential for the other columns of scan cathodes in its group.

As each of the cathode drivers 100 is operated in turn, each of the columns of scan cathodes is energized and exhibits cathode glow, in turn, with each column providing excited particles for the next adjacent column. The scan cathode glow is not visible to a viewer through plate 70.

As each of the columns of scan cathodes is energized and the scan cathodes glow, information signals applied to selected display anodes 90 cause cathode glow to transfer from the scan cathode beneath and adjacent to the selected display anodes through the constricted path 48 to the adjacent display cathode, beneath the selected display anode. The display cathode now glows, and this glow is visible to a viewer through the transparent display anodes. This operation is repeated for each column of electrode pairs, and the total scanning operation is repeated cyclically throughout the panel at such a rate that the display cathodes which are energized present an apparently stationary but changeable message. This mode of operation described above is generally similar to that employed in SELF-SCAN panels of the type described in the above-mentioned patent.

Figure 14:
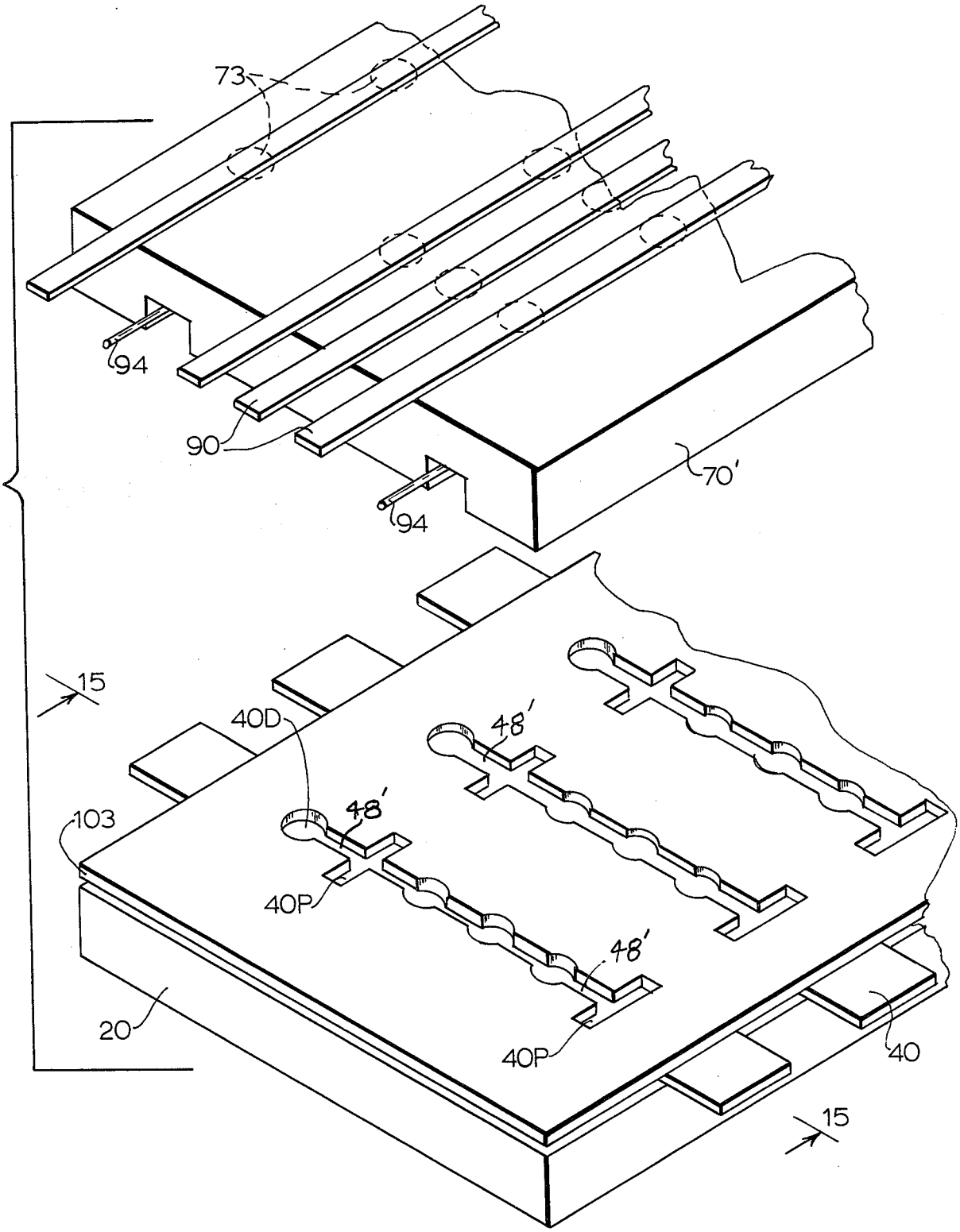
FIG. 14 is an exploded view of a portion of a display panel embodying a modification of the invention.

In a panel embodying a modification of the invention, a portion of which is shown in FIGS. 14 and 15, the vertical slots 48 provided in the center plate 70 are not required. In this panel, the cathodes 40 are provided on the base plate 20, and a layer 103 of insulating material is formed on the cathodes and on the base plate. This layer covers all of the top surface of the base plate and all of the surfaces of the cathodes except for openings which define the cathode display areas 40A, the cathode priming areas 40D, and the vertical channels 48' which connect these areas. This insulating layer 103 can be of controlled thickness, and the channels 48' can be of controlled width for the desired particle diffusion path. The plate 70' has the same structural features as plate 70 except that the vertical slots are omitted, and the thickness of the insulating layer determines the spacing of the lower surface of plate 70' from the insulating layer and thus provides the desired cross-sectional area for communication slots 49.

What is claimed is:

1. A display panel comprising a gas-filled envelope including a base plate and a face plate having a viewing window, a plurality of columns of coplanar operating cathode areas which are electrically connected in each such column, each column of operating areas including display cathode areas and printing cathode areas, said priming cathode areas providing excited particles for said display areas through restricted gas communication paths extending along said columns of cathode areas, the areas of the cathodes which form the priming and display areas being exposed to the gas within said envelope, and the restricted gas communication paths being formed by additional surface areas on said cathodes which are also exposed to the ionizable gas and which interconnect the surface areas forming the display and scan areas, each such gas communication path, between a scan and display region, being constricted in its width by a material different from that of the cathode resting on the cathode surface, to constrict, without completely blocking, the width of the cathode surface in the gas communication path, said display areas and priming areas being disposed in rows and columns, a priming anode overlying each row of priming cathode areas, and a display anode overlying each row of display cathode areas.

2. The panel defined in claim 1 wherein said priming cathode areas are hidden from view.

3. The panel defined in claim 1 including means for applying each of a succession of groups of information signals to said display anodes and said columns of display cathode areas, and means for producing a glow discharge in each column of priming cathode areas, and then in the remaining columns of priming cathode areas, one after the next, to scan said columns of priming cathode areas, one at a time, in synchronism with the application of said successive groups of information signals, to produce glow discharges in selective cells of the display cell grouping adjacent the priming cell region being scanned, one after the next, to provide an overall glow discharge pattern directly in the display cells.

4. A display panel comprising a gas-filled envelope including a base plate and a face plate having a viewing window, a plurality of coplanar cathode electrode pairs supported on said base plate, each pair comprising a first cathode and a second cathode, said cathode electrode pairs being arrayed in rows and columns, each first cathode comprising a display cathode and each second cathode comprising a priming cathode for supplying excited particles for its associated display cathode, a conductive member connecting each such priming cathode and display cathode, each said conductive member being exposed to the gas within said envelope but having an exposed surface of a width less than that of the width of the connected priming cathode, and anode electrode means for said first and second cathodes including a separate anode electrode for each row of first cathodes.

5. A display panel comprising a gas-filled envelope including a base plate and a face plate having a viewing window, a plurality of cathode electrode strips supported in said envelope with their operating surfaces facing said viewing window, means dividing said operating surfaces of said cathode electrode strips into a plurality of columns of operating cathode areas including display cathode areas and priming cathode areas, said display cathode areas being aligned in rows and columns, the priming and display areas being in gas communication and glow priming relationship so that each priming area, when it glows, primes at least one display region for glowing, each cathode including surface areas which interconnect priming and display areas to form glow priming gas communication paths, each such interconnecting area, between a scan and display area, being constricted in its width by a material different from that of the cathode resting on the cathode surface, to constrict the width of the cathode surface in the interconnecting area without completely blocking the surface in such region, priming anode electrode means in glow discharge relationship with each of said priming cathode areas, and a display anode electrode overlying each row of display cathode areas.

6. A display device comprising a gas-filled envelope including a base plate and a face plate hermetically sealed together, said face plate having a viewing window, a plurality of strip-like cathode electrodes disposed parallel to each other in a series within said envelope and having their upper surfaces facing said viewing window, means forming the upper surface of each cathode into a plurality of coplanar operating areas facing said viewing window, selected ones of said cathode areas being connected as display areas for generating display cathode glow, and others of said areas being connected as glow priming areas for generating glow priming cathode glow, there being a path through the gas in said envelope for the flow of excited particles along each cathode electrode between selected priming and display areas thereof so that excited particles generated at a priming area can flow to a display area, said paths including exposed areas of the cathode electrodes, between said priming and display areas, each such exposed area having a lesser width than that of the priming areas, and anode electrode means in glow discharge relationship with said cathodes, and conductor means for energizing said scan cathode regions in a scan pattern and synchronously energizing selected groups of said display cathode regions.

7. A display device as in claim 6 wherein said anode electrode means includes an anode electrode adjacent each of said operating areas, at least some of said anode electrodes being transparent and extending along the interior surface of the face plate.

8. A gaseous discharge display panel comprising an envelope formed of a face plate, at least portions of which are transparent, and a base plate, said plates being spaced closely to one another and sealed together to form a gas-tight enclosure, an ionizable gas within said enclosure at a pressure capable of sustaining a cathode glow discharge, a plurality of cathode electrodes mounted on said base plate in an array of rows and columns, each of such cathode electrodes having first and second surface portions exposed to the ionizable gas, the first of which forms a scan cathode region and the second a display cathode region, the surface portion which forms the display cathode region being in alignment with a transparent portion of the face plate, the scan and display regions of each cathode being in gas communication and glow priming relationship, so that each scan region, when it glows, primes the display region, each cathode including an additional surface portion which is exposed to the ionizable gas and which interconnects the surface portions forming the display and scan regions to form a glow transfer and gas communication path, each such interconnecting region having a width exposed to the ionizable gas which is substantially smaller than the width of the exposed surface of the scan region, to provide a constricted glow transfer and gas communication path, and anode electrode means in glow discharge relationship with said cathodes for energizing said scan cathode regions in a scan pattern and synchronously energizing selected groups of said display cathode regions.

9. A display panel as in claim 8 wherein each of said interconnecting regions is restricted in its width by a material different from that of the cathode resting on the cathode surface, without completely blocking the surface in such region.

10. A display panel as in claim 8 further including conductor means for scanning said scan cathodes one column after another, by causing all of the scan cathodes to glow in one column after another in a sequential scan, wherein said anode electrode means includes a plurality of anodes, each of which is in glow discharge relationship with a respective row of said display cathodes.

11. A display panel as in claim 10 further including conductor means for applying successive groups of information signals to said row anodes, one group after another, in synchronism with the scanning of the scan cathodes, to produce a predetermined glow pattern in said panel.

12. A display panel as in claim 8 wherein said anode electrode means includes an anode electrode adjacent each of said scan cathodes, all of said anode electrodes being connected electrically.

13. A display panel as in claim 8 further including a plurality of conductors, each of which connects electrically in common all of the scan cathodes of a respective one of said columns.

14. A display panel as in claim 13 further including a plurality of $n$ energizing circuits, each of which is connected electrically to a different group of said conductors, the conductors in each such group being connected to scan cathodes which are $n$ columns apart, to provide $n$ phase scanning of said scan cathodes.

15. A display panel as in claim 8 wherein each column of cathodes is formed of a single strip-like elongated cathode having scan and display regions interspersed along its length, with constricted surface regions along its length in each region interconnecting a display region with its associated scan region.

16. A display panel as in claim 8 wherein said scan regions are hidden from view through the face plate.

17. A display panel as in claim 8 wherein the constrictions in the width of the interconnecting regions, between the display and cathode regions, are formed by a center sheet of insulating material, disposed between said base plate and said face plate, said center sheet having portions which define each of the constricted areas.

18. A display panel as in claim 17 wherein the anode electrode means comprises display anodes and scan anodes which extend along the surface of said center sheet.

19. A gaseous discharge display panel comprising an envelope formed of a face plate, at least portions of which are transparent, and a base plate, said plates being spaced closely to one another and sealed together to form a gas-tight enclosure, an ionizable gas within said enclosure at a pressure capable of sustaining a cathode glow discharge, a plurality of elongated cathode electrodes within said envelope, each of such cathode electrodes including surface portions along its length which form scan cathode regions and different surface portions which form display cathode regions, the scan and display regions being interspersed along the length of each cathode and at least the display regions being in alignment with certain of the transparent portions of the base plate, said scan and display regions being disposed in an array of rows and columns, with each scan region being in gas communication and glow priming relationship with at least one display region and with the corresponding scan region in the next succeeding column, so that each scan region, when it glows, primes the corresponding scan region in the next succeeding column and at least one display region, the surface portions forming the scan and display regions being exposed to the ionizable gas within said enclosure, and each cathode including additional surface portions which are also exposed to the ionizable gas and each of which interconnects surface portions forming display and scan regions to form a glow transfer and gas communication path, each such interconnecting region, between a scan and display region, being constricted in its width by a material different from that of the cathode resting on the cathode surface to constrict, without completely blocking, the width of the cathode surface in the interconnecting region, anode electrode means in glow discharge relationship with said elongated cathodes, and conductor means for energizing said scan cathode regions in a scan pattern and synchronously energizing selected groups of said display cathode regions.

20. A display panel as in claim 19 wherein said anode electrode means includes a plurality of row conductors serving as display anodes.

21. A display panel as in claim 20 including means for sequentially scanning said scan electrodes, one column after another, and means connected to said row anodes for applying successive groups of signals to said row anodes in synchronism with the scan of the scan electrodes.

* * * * *